US012312804B2

(12) United States Patent
Hou et al.

(10) Patent No.: US 12,312,804 B2
(45) Date of Patent: May 27, 2025

(54) METHOD FOR PREPARING CONCRETE-FILLED STEEL TUBULAR EDGE-CONSTRAINED LAMINATED SHEAR WALL

(71) Applicants: Shandong University, Jinan (CN); Zhongke Zhiju (Jinan) New Materials Technology Co., Ltd., Shandong (CN)

(72) Inventors: Zhaojin Hou, Jinan (CN); Yi Liu, Jinan (CN); Hetao Hou, Jinan (CN); Zilin Du, Jinan (CN); Yinlin Mou, Jinan (CN); Zhenzhen Luo, Jinan (CN)

(73) Assignees: Shandong University, Jinan (CN); Zhongke Zhiju (Jinan) New Materials Technology Co., Ltd., Shandong (CN)

( * ) Notice: Subject to any disclaimer, the term of this patent is extended or adjusted under 35 U.S.C. 154(b) by 119 days.

(21) Appl. No.: 18/214,196

(22) Filed: Jun. 26, 2023

(65) Prior Publication Data

US 2024/0209625 A1 Jun. 27, 2024

(30) Foreign Application Priority Data

Dec. 23, 2022 (CN) ..... 202211664145.2

(51) Int. Cl.
*E04B 2/86* (2006.01)
*E04C 2/04* (2006.01)
(Continued)

(52) U.S. Cl.
CPC ..... *E04B 2/8635* (2013.01); *E04B 2/8617* (2013.01); *E04B 2002/867* (2013.01);
(Continued)

(58) Field of Classification Search
CPC ..... E04B 2/8635; E04B 2002/867; E04B 2002/8676; E04B 1/161; E04B 2/8617;
(Continued)

(56) References Cited

U.S. PATENT DOCUMENTS 3,559,355 A * 2/1971 Day, Jr. ..... E04G 9/065 52/645
4,104,842 A * 8/1978 Rockstead ..... E04B 2/8617 52/649.1

(Continued)

FOREIGN PATENT DOCUMENTS

KR 20220104324 A * 7/2022 ..... E04B 2/86

*Primary Examiner* — Omar F Hijaz
(74) *Attorney, Agent, or Firm* — Hayes Soloway P.C.

(57) ABSTRACT

Disclosed is a method for preparing a concrete-filled steel tubular edge-constrained laminated shear wall, belonging to the field of prefabricated buildings. The method allows for integrated hoisting during installation, leading to a simple working procedure and easy quality control. During manufacturing, an interior wythe board is flipped and placed on supporting members on rectangular steel tubes, no cavity formwork or bracket is needed in a cavity, and thus an operation of pulling out the cavity formwork is avoided, and high production efficiency is achieved. The rectangular steel tubes can be welded to horizontal steel bars of interior and exterior wythe boards, avoiding the cumbersome working procedure and high cost caused by stud connection while achieving reliable connection and direct force transmission.

19 Claims, 10 Drawing Sheets

(51) Int. Cl.
*E04C 2/06* (2006.01)
*E04C 2/34* (2006.01)

(52) U.S. Cl.
CPC ..... *E04B 2002/8676* (2013.01); *E04C 2/044* (2013.01); *E04C 2/06* (2013.01); *E04C 2/34* (2013.01)

(58) Field of Classification Search
CPC ... E04C 2/34; E04C 2/288; E04C 2/06; E04C 2/22; E04C 2/044
See application file for complete search history.

(56) References Cited

U.S. PATENT DOCUMENTS

| | | | | |
|---|---|---|---|---|
| 4,418,463 | A * | 12/1983 | McNeill | E04C 5/064 219/56 |
| 10,221,581 | B2 * | 3/2019 | Phillips | E04H 3/28 |
| 10,577,798 | B1 * | 3/2020 | Hodgson | E04B 2/38 |
| 11,346,100 | B1 * | 5/2022 | Blackburn | E04G 11/08 |
| 11,441,307 | B2 * | 9/2022 | Huang | E04C 2/384 |
| 2001/0010140 | A1 * | 8/2001 | Ritter | E04C 2/049 52/649.1 |
| 2004/0055237 | A1 * | 3/2004 | Bravinski | E04B 2/8647 52/309.11 |
| 2021/0372136 | A1 * | 12/2021 | Shaw | E04F 13/0733 |
| 2022/0356705 | A1 * | 11/2022 | Hulsizer | E04G 21/12 |

* cited by examiner

METHOD FOR PREPARING CONCRETE-FILLED STEEL TUBULAR EDGE-CONSTRAINED LAMINATED SHEAR WALL

CROSS-REFERENCE TO RELATED APPLICATION

This patent application claims the benefit and priority of Chinese Patent Application No. 202211664145.2, filed with the China National Intellectual Property Administration on Dec. 23, 2022, the disclosure of which is incorporated by reference herein in its entirety as part of the present application.

TECHNICAL FIELD

The present disclosure relates to the field of prefabricated buildings, and in particular to a method for preparing a concrete-filled steel tubular edge-constrained laminated shear wall.

BACKGROUND

Precast concrete laminated shear walls consist of prefabricated and cast-in-place parts. The prefabricated part is a component with an intermediate cavity formed by connecting two layers of prefabricated reinforced concrete panels (referred to as "interior wythe board and exterior wythe board") through connectors. The connectors of the prefabricated part include but are not limited to lattice steel bars (steel-bars trusses), profiled steel or steel strips, etc. The intermediate cavity of the prefabricated part is used for pouring concrete on site. The post-cast concrete can bear force together with the prefabricated part and finally form an integral Precast concrete laminated shear wall.

The concrete-filled steel tubular edge-constrained laminated shear wall is an improvement on traditional precast concrete laminated shear wall. The boundary members of the traditional precast concrete laminated shear wall are replaced by rectangular steel tubes. An example of the concrete-filled steel tubular edge-constrained laminated shear wall can be referred to Chinese Patent CN105569224A.

The existing method for making the concrete-filled steel tubular edge-constrained laminated shear wall includes the following steps: firstly, the reinforcing steel mesh for an interior wythe board is manufactured, and horizontal steel bars of the reinforcing steel mesh for the interior wythe board are welded to rectangular steel tubes provided with studs and erected on both sides. Then, connectors for the interior and exterior wythe boards are installed on the reinforcing steel mesh for the interior wythe board. Furthermore, concrete molds at both ends of the rectangular steel tubes are installed, the interior wythe board concrete is poured, vibrated and compacted. Then, a cavity formwork (polystyrene board) is laid on the interior wythe board, and a reinforcing steel mesh for the exterior wythe board is placed and the horizontal steel bars of the reinforcing steel mesh are welded to the rectangular steel tubes erected on both sides. Finally, the exterior wythe board concrete is poured, vibrated and compacted, and after the concrete is cured to a specified strength for demolding, the formworks at both ends of the rectangular steel tubes can be removed, and polystyrene formwork is pulled away to complete production.

The above method achieves the overall production of the concrete-filled steel tubular edge-constrained laminated shear wall. But after production is completed, it is difficult to remove the built-in polystyrene formwork, leading to low fabrication efficiency. Moreover, the rectangular steel tubes are connected to the laminated shear wall using stud connections, which is cumbersome and costly.

SUMMARY

The present disclosure provides a method for preparing a concrete-filled steel tubular edge-constrained laminated shear wall, which can the overall prefabrication of the concrete-filled steel tubular edge-constrained laminated shear wall without the need for a cavity formwork, and has high production efficiency, simple operation, and low cost.

The technical solution provided by the present disclosure is as follows:

A method for preparing a concrete-filled steel tubular edge-constrained laminated shear wall includes the following steps:

S1: manufacturing a reinforcing steel mesh for an interior wythe board according to a design size of an interior wythe board, and fixing connectors to the reinforcing steel mesh for the interior wythe board;

S2: placing the reinforcing steel mesh for the interior wythe board and the connectors on a production pallet as a whole, and enabling the connectors to be above the reinforcing steel mesh for the interior wythe board, erecting an interior wythe board mold, pouring interior wythe board concrete, and removing the interior wythe board mold after the concrete is cured to a specified strength; and S3: manufacturing a reinforcing steel mesh for an exterior wythe board according to a design size of an exterior wythe board, arranging rectangular steel tubes on both sides of the reinforcing steel mesh for the exterior wythe board, and welding both ends of horizontal steel bars of the reinforcing steel mesh for the exterior wythe board to the rectangular steel tubes;

where the design width of the interior wythe board is smaller than that of the exterior wythe board by a set value;

S4: welding supporting members at set positions on outer surfaces of inner side walls of the rectangular steel tubes, placing the reinforcing steel mesh for the exterior wythe board and the rectangular steel tubes on the production pallet as a whole, erecting end formworks for the exterior wythe board, using the rectangular steel tubes as side formworks for the exterior wythe board, and pouring exterior wythe board concrete;

S5: flipping the interior wythe board and the connectors as a whole by 180°, placing both ends of the interior wythe board in the width direction on the supporting members, and anchoring the connectors into the poured exterior wythe board concrete for a set distance, vibrating and compacting the exterior wythe board concrete, and removing the end formworks for the exterior wythe board after the concrete is cured to a specified strength;

where the arrangement positions of the supporting members should meet the requirement that a top surface of the interior wythe board is flush with top surfaces of the rectangular steel tubes after both ends of the interior wythe board in the width direction are placed on the supporting members;

S6: filling gaps between the interior wythe board and the rectangular steel tubes with slurry for gap sealing, thus completing the preparation of the concrete-filled steel tubular edge-constrained shear wall.

Further, in S5, bottom surfaces of both ends of the interior wythe board in the width direction are placed on top surfaces of the supporting members.

Further, in S1, both ends of the horizontal steel bars of the reinforcing steel mesh for the interior wythe board extend outward from both sides of interior wythe board in the width direction by a set length. The extended part of horizontal steel bars of the reinforcing steel mesh for the interior wythe board is sleeved with a protective sleeve.

Further, S2 further includes: removing the protective sleeves after the concrete is cured to the specified strength.

Further, S5 further includes: placing horizontal steel bars extending from both sides along the width direction of the interior wythe board on the top surfaces of the supporting members, and welding the horizontal steel bars extending from both sides of the width of the interior wythe board to the supporting members.

Further, S1 further includes: welding a connecting plate to each end of the horizontal steel bars of the reinforcing steel mesh for the interior wythe board. The height and length of the connecting plate are equal to the thickness and length of the design size of the interior wythe board.

When an interior wythe board mold is erected in S2, end formworks for the interior wythe board are erected, and the connecting plates are used as side formworks for the interior wythe board.

S5 further includes: placing bottom surfaces of the connecting plates at both ends of the interior wythe board on the top surfaces of the supporting members, and welding the connecting plates to the supporting members.

Further, the connecting plate includes a first vertical edge and a first horizontal edge. The first vertical edge is welded to both ends of horizontal steel bars of the reinforcing steel mesh for the interior wythe board and the first vertical edge is located on both end surfaces of the interior wythe board. The first horizontal edge is located on top surface of the interior wythe board before flipping, and top surface of first horizontal edge is flush with top surface of the interior wythe board before flipping.

Further, the supporting members each include a second vertical edge and a second horizontal edge. The second vertical edges are welded to the outer surfaces of the inner side walls of the rectangular steel tubes, and the second horizontal edges are used for placing both ends of the interior wythe board in the width direction.

Further, the connectors are steel-bars truss, profiled steel or steel strip.

Further, the slurry is micro-expansive high-strength cement mortar or fine aggregate concrete.

Further, the top ends of the rectangular steel tubes extend above the top ends of the interior wythe board and the exterior wythe board, and bottom ends of the rectangular steel tubes extend below the bottom ends of the interior wythe board and the exterior wythe board.

The present disclosure has the following beneficial effects:

In accordance with the present disclosure, interior wythe board concrete is firstly poured and cured to a specified strength, then exterior wythe board concrete is poured with rectangular steel tubes as side formworks, the interior wythe board is flipped and placed on supporting members on the rectangular steel tubes. Connectors on the interior wythe board are anchored into the exterior wythe board concrete, slurry is filled between the interior wythe board and the rectangular steel tubes for gap sealing, thus achieving overall prefabrication of the rectangular steel tubes and composite concrete shear wall.

During installation, the concrete-filled steel tubular edge-constrained laminated shear wall can be hoisted as a whole with simple working procedure, quality of which is easy to control. When manufacturing the concrete-filled steel tubular edge-constrained laminated shear wall, after flipping the interior wythe board and placing the interior wythe board on the supporting members on the rectangular steel tubes, there is no need to set up cavity formwork or a bracket in cavity, thus avoiding an operation of pulling out the cavity formwork and achieving high production efficiency. The rectangular steel tubes can be welded to the horizontal steel bars on the interior and exterior wythe boards, connection quality of which is reliable and force transmission is direct, thus the defects of cumbersome working procedure and high cost caused by stud connection can be avoided. The rectangular steel tubes on both sides are used as side formworks for the exterior wythe board and are integrally cast with the exterior wythe board, and thus the side formworks for the exterior wythe board are saved, and the working procedure is simple, time-saving and labor-saving. The problem of gaps between the rectangular steel tubes and the interior and exterior wythe boards is solved. The joint treatment between the steel tubes and the laminated shear wall is eliminated. The grout leakage of the post-cast concrete on site is avoided. The overall performance is better.

DETAILED DESCRIPTION OF THE EMBODIMENTS

In order to make the technical problems, technical solutions and advantages to be solved by the present disclosure more clearly, the present disclosure is described in detail below with reference to accompanying drawings and specific embodiments.

Figure 1:
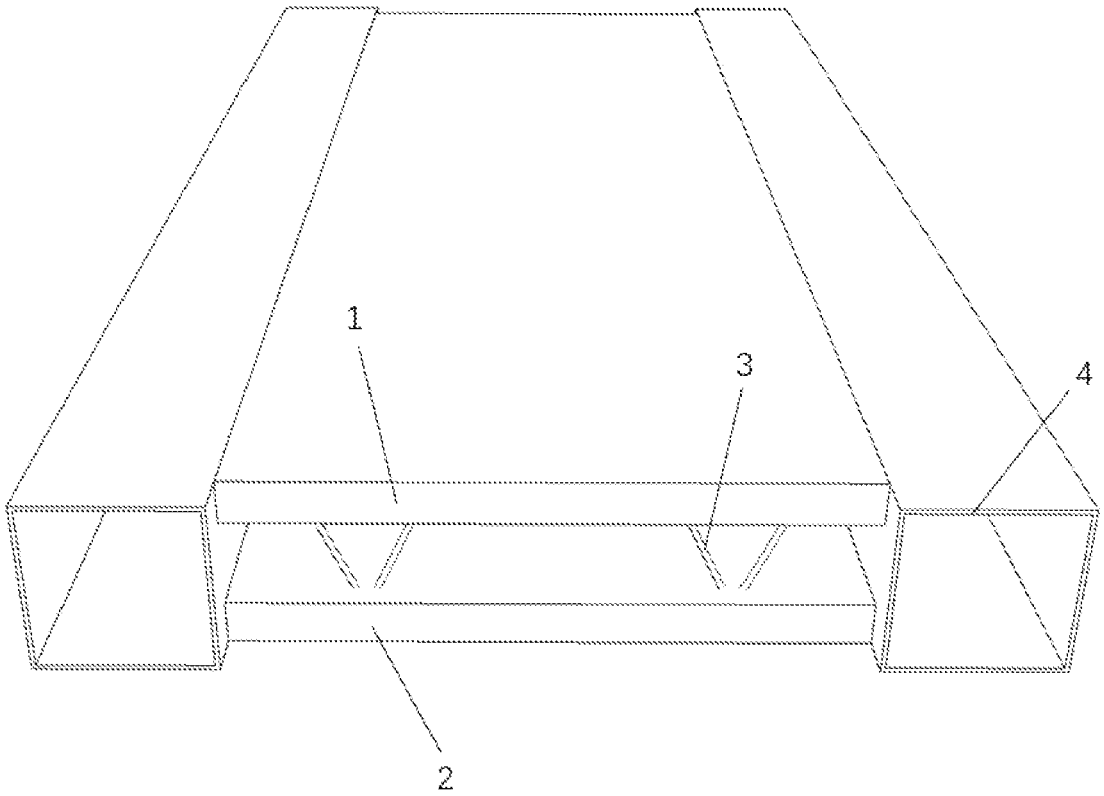
FIG. 1 is a three-dimensional view of a concrete-filled steel tubular edge-constrained laminated shear wall.
Figure 2:
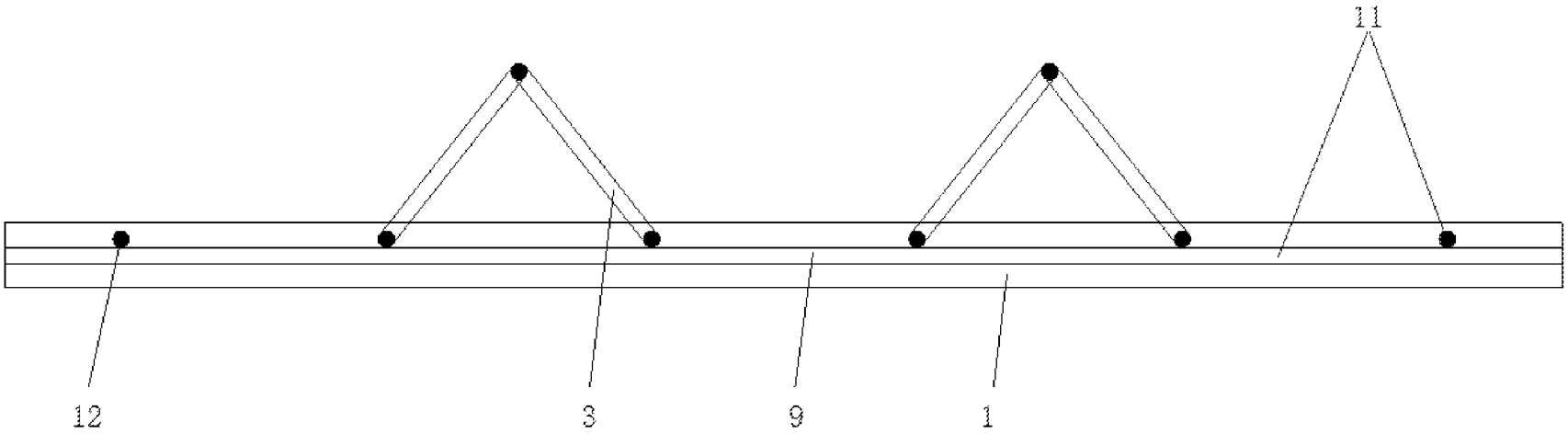
FIG. 2 is a schematic diagram of the preparation of an interior wythe board.
Figure 3:
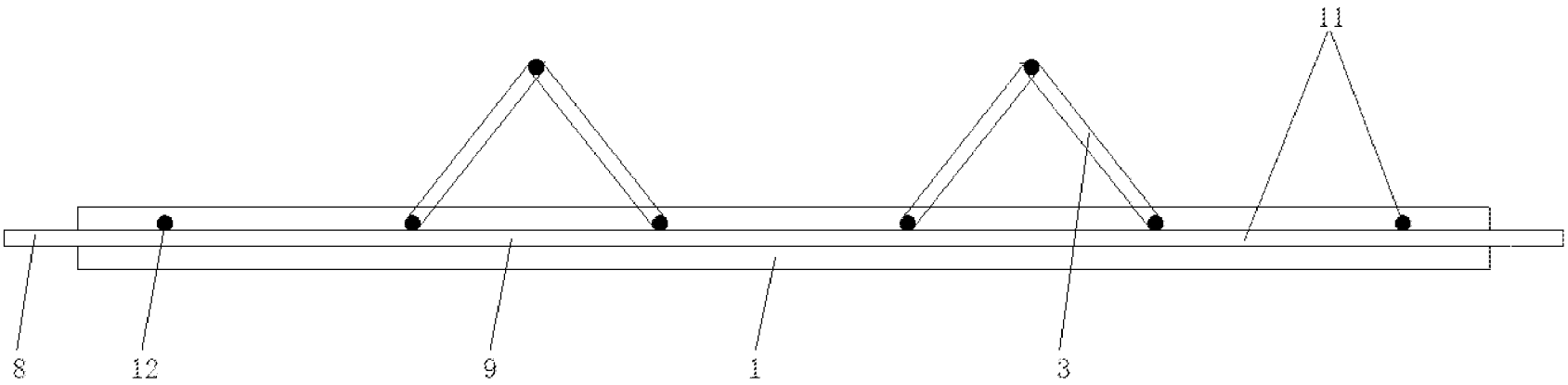
FIG. 3 is another schematic diagram of the preparation of an interior wythe board.
Figure 4:
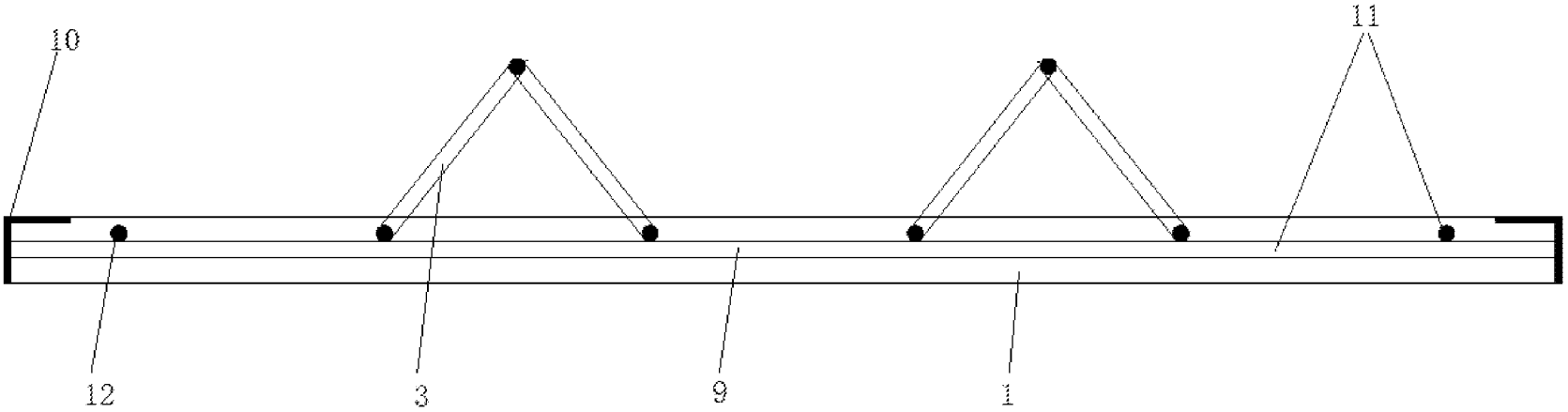
FIG. 4 is still another schematic diagram of the preparation of an interior wythe board.

The schematic diagram of a concrete-filled steel tubular edge-constrained laminated shear wall is shown in FIG. 1, which includes an interior wythe board 1, an exterior wythe board 2, connectors 3, and rectangular steel tubes 4. The interior wythe board 1 and the exterior wythe board 2 are connected by the connecting parts 3 with a cavity therebetween, and the rectangular steel tubes 4 are connected to both sides of widths of the interior wythe board 1 and the exterior wythe board 2. As shown in FIG. 2-FIG. 10, the method for preparing the concrete-filled steel tubular edge-constrained laminated shear wall includes the following steps:

S1: A reinforcing steel mesh 11 for an interior wythe board is manufactured according to a design size of an interior wythe board 1, and connectors 3 are fixed to the reinforcing steel mesh 11 for the interior wythe board, as shown in FIG. 2 to FIG. 4.

The reinforcing steel mesh 11 for the interior wythe board includes horizontal steel bars 9 and vertical steel bars 12. The connecting parts 3 each may be a steel-bar girder, profiled steel or a steel strip, etc., and is fixed to the reinforcing steel mesh 11 for the interior wythe board by welding or other ways.

S2: The reinforcing steel mesh 11 for the interior wythe board and the connectors 13 are placed on a production pallet as a whole, and the connectors 3 are positioned above the reinforcing steel mesh 11 for the interior wythe board. An interior wythe board mold is erected, interior wythe board concrete is poured, and the interior wythe board mold is removed after the concrete is cured to a specified strength, thus completing the preparation of the interior wythe board 1, as shown in FIG. 2 to FIG. 4.

Figure 5:
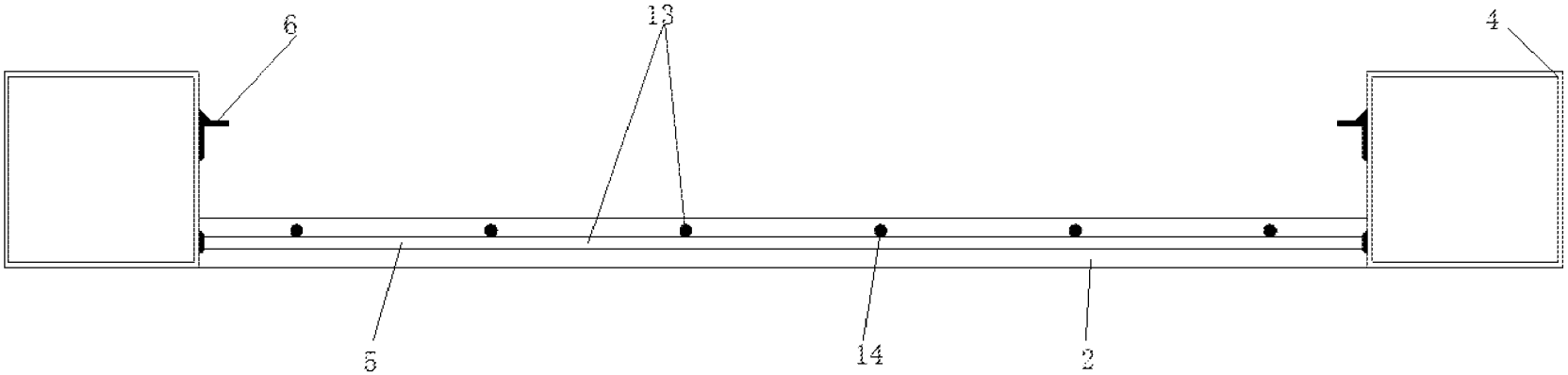
FIG. 5 is a schematic diagram of the preparation of an exterior wythe board.
Figure 6:
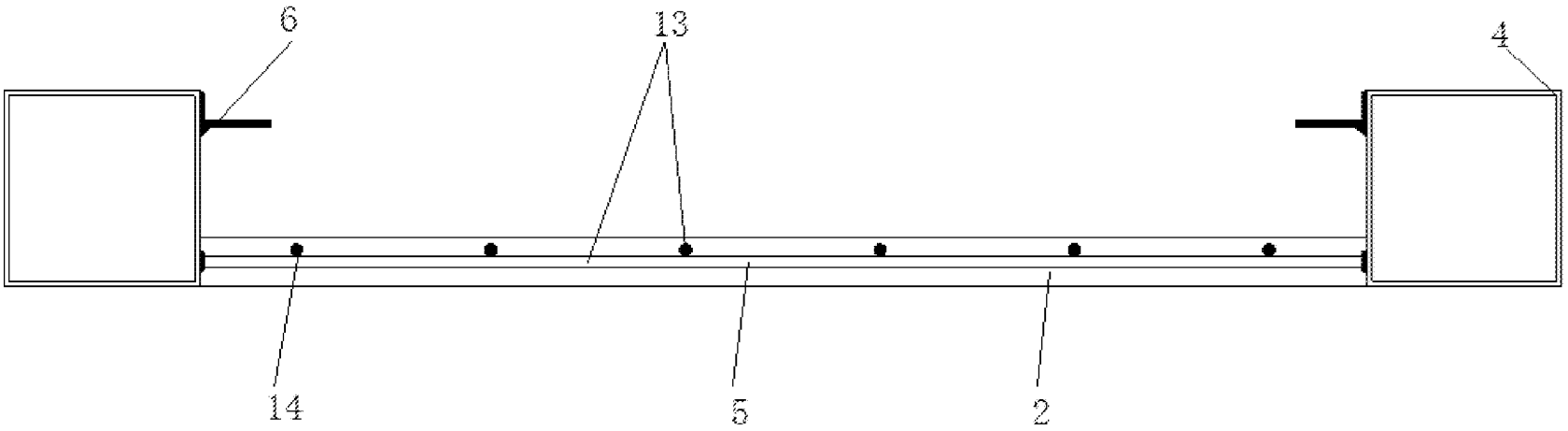
FIG. 6 is another schematic diagram of the preparation of an exterior wythe board.
Figure 7:
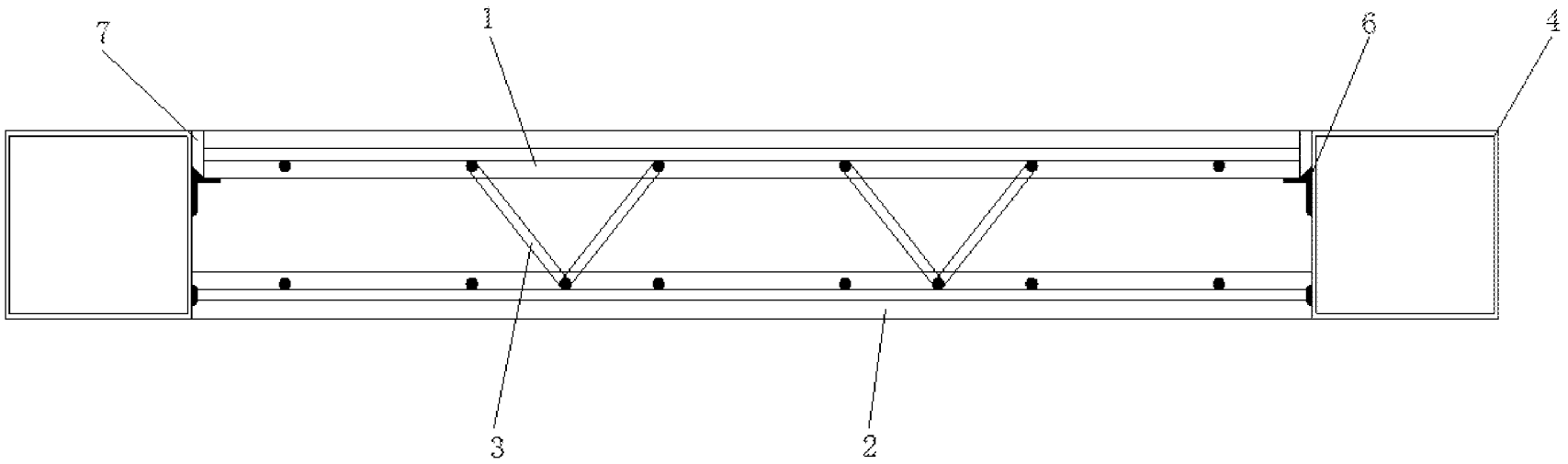
FIG. 7 is a sectional view of a concrete-filled steel tubular edge-constrained laminated shear wall prepared from an interior wythe board in FIG. 2 and an exterior wythe board in FIG. 5.
Figure 8:
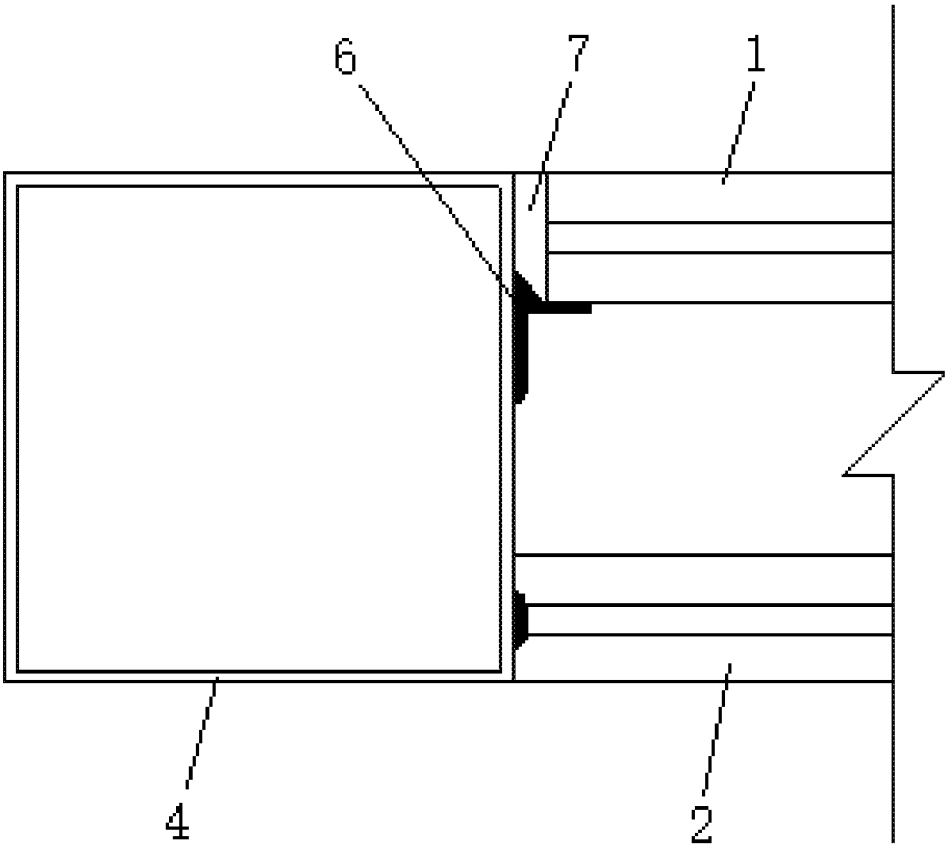
FIG. 8 is a partial enlarged view of FIG. 7.

S3: A reinforcing steel mesh 13 for an exterior wythe board is manufactured according to the design of an exterior wythe board 2, and rectangular steel tubes 4 are arranged on both sides in the width direction of the reinforcing steel mesh 13 for the exterior wythe board. The reinforcing steel mesh 13 for the exterior wythe board includes horizontal steel bars 5 and vertical steel bars 14. Both ends of the horizontal steel bars 5 of the reinforcing steel mesh 13 for the exterior wythe board are welded to the rectangular steel tubes 4, as shown in FIG. 5 and FIG. 6.

The design width of the interior wythe board 1 is smaller than that of the exterior wythe board 2 by a set value.

S4: Supporting members 6 are welded at set positions on outer surfaces of inner side walls of the rectangular steel tubes 4, the reinforcing steel mesh 13 for the exterior wythe board and the rectangular steel tubes 4 are placed on the production pallet as a whole, end formworks for the exterior wythe board are erected, the rectangular steel tubes 4 are used as side formworks for the exterior wythe board, and then exterior wythe board concrete is poured, as shown in FIG. 5 and FIG. 6.

The set positions of the supporting members 6 should meet the requirement that the top surface of the interior wythe board 1 is flush with top surfaces of the rectangular steel tubes 4 after both ends in the width direction of the interior wythe board 1 are placed on the supporting members 6 in S5.

The rectangular steel tubes 4 on both sides are used as side formworks for the exterior wythe board and are integrally cast with the exterior wythe board 2, and thus the side formworks for the exterior wythe board 2 are saved, and the working procedure is simple, time-saving and labor-saving. The problems such as vertical deviation of the rectangular steel tubes 4 and gaps between the rectangular steel tubes 4 and the exterior wythe board 2 are solved. The grout leakage of the post-cast concrete on site is avoided. The overall performance is better.

S5: The interior wythe board 1 and the connectors 3 are flipped as a whole by 180°. Both ends in the width direction of the interior wythe board 1 are placed on the supporting members 6, and lower ends of the connectors 3 are anchored into the poured exterior wythe board concrete for a set distance. After the exterior wythe board concrete is vibrated, compacted and cured to a specified strength, the end formworks for the exterior wythe board 2 are removed.

When the connector 3 is a steel-bar truss, profiled steel or steel strip, the lower chord of the steel-bars truss, lower flange of the profiled steel or lower end of the steel strip should be anchored into the poured exterior wythe board concrete.

S6: Gaps between the interior wythe board 1 and the rectangular steel tubes 4 are filled with slurry such as micro-expansion high-strength cement mortar or fine aggregate concrete for gap sealing, thus completing the preparation of the concrete-filled steel tubular edge-constrained laminated shear wall.

The filled slurry (7) can prevent gaps between the rectangular steel tubes (4) and the exterior wythe board 1, which avoids grout leakage during pouring concrete on site and also prevents structure exposure and makes the surface of the shear wall flat and smooth.

In accordance with the present disclosure, the interior wythe board concrete is firstly poured and cured to a specified strength, then the exterior wythe board concrete is poured with the rectangular steel tubes as side formworks. The interior wythe board is flipped and placed on the supporting members on the rectangular steel tubes. The connectors on the interior wythe board are anchored into the exterior wythe board concrete. Slurry is filled between the interior wythe board and the rectangular steel tubes for gap sealing, thus achieving overall prefabrication of the rectangular steel tubes and the laminated concrete shear wall.

During installation, the concrete-filled steel tubular edge-constrained laminated shear wall can be hoisted as a whole, with a simple working procedure and easy quality control. When manufacturing the concrete-filled steel tubular edge-constrained laminated shear wall, after flipping the interior wythe board and placing the interior wythe board on the supporting members on the rectangular steel tubes, there is no need to set up a cavity formwork or a bracket, and thus the operation of pulling out the cavity formwork is avoided and high production efficiency is achieved. The rectangular steel tubes can be welded to horizontal steel bars of the interior and exterior wythe boards, connection quality of which is reliable and force transmission is direct, thus avoiding the cumbersome working procedure and high cost caused by stud connection. The rectangular steel tubes on both sides are used as side formworks for the exterior wythe board and are integrally cast with the exterior wythe board concrete, thus saving side formworks for the exterior wythe board are saved, and the working procedure is simple, time-saving and labor-saving. The problem of gaps between the rectangular steel tubes and the interior and exterior wythe boards is solved. The joint treatment between the steel tubes and the laminated shear wall is eliminated. The grout leakage of the post-cast concrete on site is avoided. The overall performance is better.

As an improvement, in S5, after flipping the interior wythe board 1 and the connectors 3 as a whole by 180°, bottom surfaces of both ends in the width direction of the interior wythe board 1 can be directly placed on top surfaces of the supporting members 6 as shown in FIG. 5, and such a construction mode is simple and fast.

In this case, lengths of the horizontal steel bars 9 and the vertical steel bars 12 of the reinforcing steel mesh 11 for the interior wythe board are equal to the length and width of the design size of the interior wythe board 1, respectively, as shown in FIG. 2. The width of the interior wythe board 1 is smaller than that of the by 5-10 mm smaller than that of the exterior wythe board 2. A height difference between the top surface of each supporting member 6 and the top surface of each rectangular steel tube 4 is equal to the thickness of the interior wythe board 1 which is taken as 50 mm. The protruding length of supporting member 6 is taken as 30 mm. The lower ends of connectors 3 are anchored into the poured exterior wythe board concrete at a distance of 30 mm.

As another improvement, in S1, both ends of the horizontal steel bars 9 of the reinforcing steel mesh 11 for the interior wythe board extend outward from both sides in the width direction width of the interior wythe board 1 by a set length, as shown in FIG. 3. Extended parts 8 of the horizontal steel bars 9 of the reinforcing steel mesh 11 for the interior wythe board are sleeved with protective sleeves.

The extended length of each horizontal steel bar 9 is not less than 5 times a diameter of the horizontal steel bar 9, The protective sleeve is used to prevent the horizontal steel bar 9 from bonding with the poured interior wythe board concrete. Under this circumstance, the width of the interior wythe board 1 is 10 mm smaller than that of the exterior wythe board 2 by 10 mm.

Correspondingly, S2 further includes the step of removing the protective sleeves after the concrete is cured to a specified strength. In S4, the height difference between the top surface of the supporting member 6 and the top surface of rectangular steel tube 4 is 30 mm, and the protruding length of the supporting member 6 is not less than 5.5 times the diameter of the horizontal steel bar 9, as shown in FIG. 6.

Figure 9:
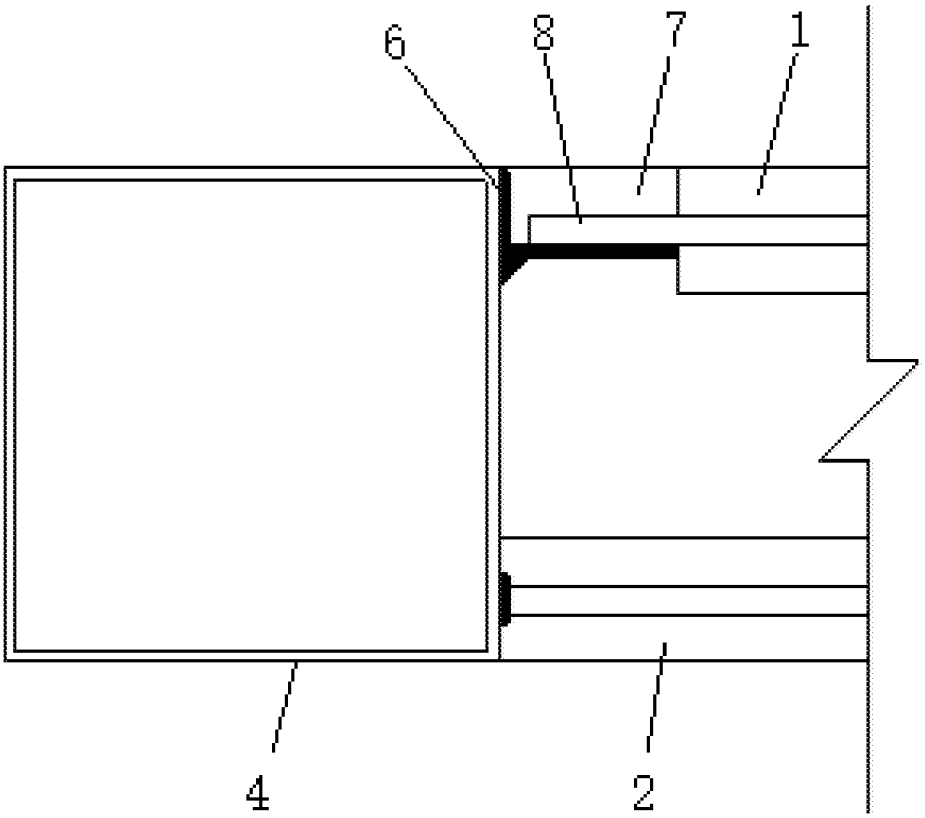
FIG. 9 is a partial sectional view of a concrete-filled steel tubular edge-constrained laminated shear wall prepared from an interior wythe board in FIG. 3 and an exterior wythe board in FIG. 6.

Accordingly, S5 further includes: placing the horizontal steel bars 8 extending from both sides of the width of the interior wythe board 1 on the top surfaces of the supporting members 6, welding the horizontal steel bars 8 extending from both sides of the width of the interior wythe board 1 to the supporting members 6, so as to achieve reliable connection between the rectangular steel tubes 4 and the horizontal steel bars of the interior wythe board and the exterior wythe board reliably, as shown in FIG. 9. Under this circumstance, the lower ends of the connectors 3 are anchored into the poured exterior wythe board concrete at a distance of 30 mm.

As yet another improvement, S1 further includes: welding a connecting plate 10 to each of both ends of the horizontal steel bars 9 of the reinforcing steel mesh 13 for the interior wythe board. The height and length of the connecting plate 10 are equal to the thickness and length of the design size of the interior wythe board 1, as shown in FIG. 4.

Correspondingly, when an interior wythe board mold is erected in S2, end formworks for the interior wythe board are erected, and the connecting plates 10 are used as the side formworks for the interior wythe board. Under this circumstance, the width of the interior wythe board 1 is 10 mm smaller than that of the exterior wythe board 2.

In S4, the height difference between the top surface of the supporting member 6 and the top surface of the rectangular steel tube 4 is equal to the thickness of the interior wythe board 1, which is taken as 50 mm. The protruding length of the supporting member 6 is taken as 30 mm, as shown in FIG. 5.

Figure 10:
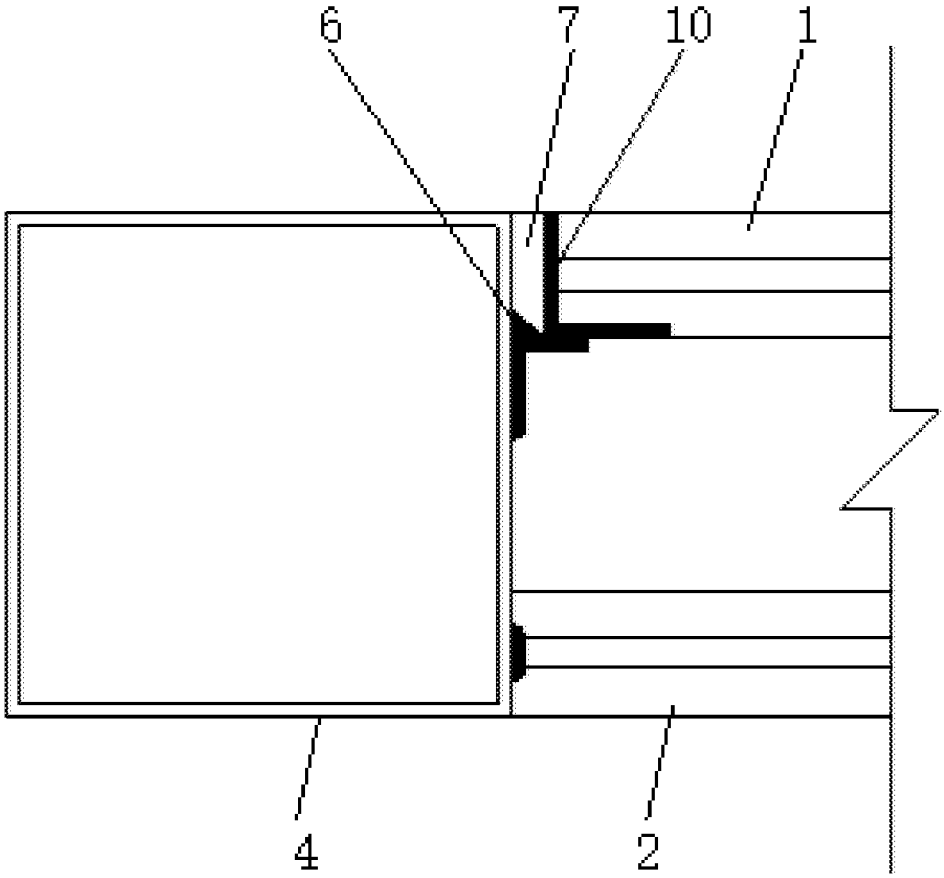
FIG. 10 is a partial sectional view of a concrete-filled steel tubular edge-constrained laminated shear wall prepared from an interior wythe board in FIG. 4 and an exterior wythe board in FIG. 5.

Correspondingly, S5 further includes: placing bottom surfaces of the connecting plates 10 at both ends of the width of the interior wythe board 1 on the top surfaces of the supporting members 6, and welding the connecting plates 10 to the supporting members 6, so as to achieve reliable connection between the rectangular steel tubes 4 and the horizontal steel bars 9 and 5 of the interior wythe board and the exterior wythe board reliably, as shown in FIG. 10. Under this circumstance, the lower ends of the connecting parts 3 are anchored into the poured exterior wythe board concrete at a distance of 30 mm.

The present disclosure does not limit the specific structure form of the connecting plates 10. As an example, as shown in FIG. 4, the connecting plate 10 may be angle steel, which includes a first vertical edge and a first horizontal edge. The first vertical edge is welded to both ends of the horizontal steel bars 9 of the reinforcing steel mesh 11 for the interior wythe board, and the first vertical edges are located on both end surfaces in the width direction of the interior wythe board 1. The first horizontal edge is located on the top surface of the interior wythe board 1 before flipping, and the top surface of the first horizontal edge is flush with the top surface of the interior wythe board 1 before flipping.

As shown in FIG. 5 and FIG. 6, the aforementioned supporting member 6 may be angle steel or ribbed steel plate, which includes a second vertical edge and a second horizontal edge. The second vertical edge is welded to the outer surface of the inner side wall of the rectangular steel tubes 4, and the second horizontal edge extends horizontally inward for placing both ends of the width of the interior wythe board 1.

The top end of the rectangular steel tube 4 can extend above the top ends of the interior wythe board 1 and the exterior wythe board 2: extended height=floor thickness+(10-20) mm. The bottom ends of the rectangular steel tubes 4 can extend below the bottom ends of the interior wythe board 1 and the exterior wythe board 2: extended length is about 40 to 50 mm. Therefore, it is convenient for the connection between the upper and lower concrete-filled steel tubular edge-constrained laminated shear walls at the floor slab and reserves space for welding the upper and lower rectangular steel tubes.

The above-mentioned are the preferred embodiments of the present disclosure. It should be noted that for those of ordinary skill in the art, several variations and modifications can be made without departing from the concept of the present disclosure, all of which fall within the scope of protection of the present disclosure.

What is claimed is:

1. A method for preparing a concrete-filled steel tubular edge-constrained laminated shear wall, comprising the following steps:

S1: manufacturing a reinforcing steel mesh for an interior wythe board according to a design size of an interior wythe board, and fixing connectors to the reinforcing steel mesh for the interior wythe board;

S2: placing the reinforcing steel mesh for the interior wythe board and the connectors on a production pallet as a whole, and enabling the connectors to be above the reinforcing steel mesh for the interior wythe board, erecting an interior wythe board mold, pouring interior wythe board concrete, and removing the interior wythe board mold after the concrete is cured to a specified strength; and S3: manufacturing a reinforcing steel mesh for an exterior wythe board according to a design size of an exterior wythe board, arranging rectangular steel tubes on both sides of the reinforcing steel mesh for the exterior wythe board, and welding both ends of horizontal steel bars of the reinforcing steel mesh for the exterior wythe board to the rectangular steel tubes;

wherein the design width of the interior wythe board is smaller than that of the exterior wythe board by a set value;

S4: welding supporting members at set positions on outer surfaces of inner side walls of the rectangular steel tubes, placing the reinforcing steel mesh for the exterior wythe board and the rectangular steel tubes on the production pallet as a whole, erecting end formworks for the exterior wythe board, using the rectangular steel tubes as side formworks for the exterior wythe board, and pouring exterior wythe board concrete;

S5: flipping the interior wythe board and the connectors as a whole by 180°, placing both ends of the interior wythe board in the width direction on the supporting members, and anchoring the connectors into the poured exterior wythe board concrete, vibrating and compacting the exterior wythe board concrete, and removing the end formworks for the exterior wythe board after the concrete is cured to a specified strength;

wherein arrangement positions of the supporting members meet a requirement that a top surface of the interior wythe board is flush with top surfaces of the rectangular steel tubes after both ends of the interior wythe board in the width direction are placed on the supporting members;

S6: filling gaps between the interior wythe board and the rectangular steel tubes with slurry for gap sealing, thus completing the preparation of the concrete-filled steel tubular edge-constrained shear wall.

2. The method for preparing a concrete-filled steel tubular edge-constrained laminated shear wall according to claim 1, wherein in S5, bottom surfaces of both ends in the width direction of the interior wythe board are placed on top surfaces of the supporting members.

3. The method for preparing a concrete-filled steel tubular edge-constrained laminated shear wall according to claim 1, wherein in S1, both ends of the horizontal steel bars of the reinforcing steel mesh for the interior wythe board extend outward from both sides of interior wythe board in the width direction by a set length, and extended parts of the horizontal steel bars of the reinforcing steel mesh for the interior wythe board are sleeved with protective sleeves;

S2 further comprises: removing the protective sleeves after the concrete is cured to the specified strength; and S5 further comprises: placing horizontal steel bars extending from both sides along the width direction of the interior wythe board on the top surfaces of the supporting members, and welding the horizontal steel bars extending from both sides of the width of the interior wythe board to the supporting members.

4. The method for preparing a concrete-filled steel tubular edge-constrained laminated shear wall according to claim 1, wherein S1 further comprise: welding a connecting plate to each end of the horizontal steel bars of the reinforcing steel mesh for the interior wythe board, wherein the height and length of the connecting plate are equal to the thickness and length of the design size of the interior wythe board;

when an interior wythe board mold is erected in S2, end formworks for the interior wythe board are erected, and the connecting plates are used as side formworks for the interior wythe board;

S5 further comprises: placing bottom surfaces of the connecting plates at both ends of the interior wythe board on the top surfaces of the supporting members, and welding the connecting plates to the supporting members.

5. The method for preparing a concrete-filled steel tubular edge-constrained laminated shear wall according to claim 4, wherein the connecting plates each comprise a first vertical edge and a first horizontal edge, the first vertical edges are welded to both ends of the horizontal steel bars of the reinforcing steel mesh for the interior wythe board, and the first vertical edges are located on two end faces of the interior wythe board; the first horizontal edges are located on the top surface of the interior wythe board before flipping, and top surfaces of the first horizontal edges are flush with the top surface of the interior wythe board before flipping.

6. The method for preparing a concrete-filled steel tubular edge-constrained laminated shear wall according to claim 1, wherein the supporting members each comprise a second vertical edge and a second horizontal edge, the second vertical edges are welded to the outer surfaces of the inner side walls of the rectangular steel tubes, and the second horizontal edges are used for placing both ends of the interior wythe board in the width direction.

7. The method for preparing a concrete-filled steel tubular edge-constrained laminated shear wall according to claim 2, wherein the supporting members each comprise a second vertical edge and a second horizontal edge, the second vertical edges are welded to the outer surfaces of the inner side walls of the rectangular steel tubes, and the second horizontal edges are used for placing both ends of the interior wythe board in the width direction.

8. The method for preparing a concrete-filled steel tubular edge-constrained laminated shear wall according to claim 3, wherein the supporting members each comprise a second vertical edge and a second horizontal edge, the second vertical edges are welded to the outer surfaces of the inner side walls of the rectangular steel tubes, and the second horizontal edges are used for placing both ends of the interior wythe board in the width direction.

9. The method for preparing a concrete-filled steel tubular edge-constrained laminated shear wall according to claim 4, wherein the supporting members each comprise a second vertical edge and a second horizontal edge, the second vertical edges are welded to the outer surfaces of the inner side walls of the rectangular steel tubes, and the second horizontal edges are used for placing both ends of the interior wythe board in the width direction.

10. The method for preparing a concrete-filled steel tubular edge-constrained laminated shear wall according to claim 5, wherein the supporting members each comprise a second vertical edge and a second horizontal edge, the second vertical edges are welded to the outer surfaces of the inner side walls of the rectangular steel tubes, and the second horizontal edges are used for placing both ends of the interior wythe board in the width direction.

11. The method for preparing a concrete-filled steel tubular edge-constrained laminated shear wall according to claim 6, wherein the connectors are steel-bar truss, profiled steel or steel strip.

12. The method for preparing a concrete-filled steel tubular edge-constrained laminated shear wall according to claim 7, wherein the connectors are steel-bar truss, profiled steel or steel strip.

13. The method for preparing a concrete-filled steel tubular edge-constrained laminated shear wall according to claim 8, wherein the connectors are steel-bar truss, profiled steel or steel strip.

14. The method for preparing a concrete-filled steel tubular edge-constrained laminated shear wall according to claim 9, wherein the connectors are steel-bar truss, profiled steel or steel strip.

15. The method for preparing a concrete-filled steel tubular edge-constrained laminated shear wall according to claim 10, wherein the connectors are steel-bar truss, profiled steel or steel strip.

16. The method for preparing a concrete-filled steel tubular edge-constrained laminated shear wall according to claim 11, wherein the slurry is micro-expansive high-strength cement mortar or fine aggregate concrete.

17. The method for preparing a concrete-filled steel tubular edge-constrained laminated shear wall according to claim 12, wherein the slurry is micro-expansive high-strength cement mortar or fine aggregate concrete.

18. The method for preparing a concrete-filled steel tubular edge-constrained laminated shear wall according to claim 13, wherein the slurry is micro-expansive high-strength cement mortar or fine aggregate concrete.

19. The method for preparing a concrete-filled steel tubular edge-constrained laminated shear wall according to claim 14, wherein the slurry is micro-expansive high-strength cement mortar or fine aggregate concrete.

* * * * *